US012760534B2

(12) United States Patent
Chen

(10) Patent No.: US 12,760,534 B2
(45) Date of Patent: Oct. 13, 2026

(54) DECOUPLED FLOOR UNDERLAYMENT

(71) Applicant: Shandong Blosam New Material Co., Ltd, Weifang (CN)

(72) Inventor: Lixia Chen, Weifang (CN)

(73) Assignee: Shandong Blosam New Material Co., Ltd, Weifang (CN)

( * ) Notice: Subject to any disclaimer, the term of this patent is extended or adjusted under 35 U.S.C. 154(b) by 213 days.

(21) Appl. No.: 18/491,937

(22) Filed: Oct. 23, 2023

(65) Prior Publication Data

US 2025/0034885 A1 Jan. 30, 2025

(30) Foreign Application Priority Data

Jul. 26, 2023 (CN) ..... 202310924444.3

(51) Int. Cl.

| | |
|---|---|
| ***F24D 13/04*** | (2006.01) |
| ***E04F 15/18*** | (2006.01) |
| *E04F 15/02* | (2006.01) |
| *F24D 3/14* | (2006.01) |

(52) U.S. Cl.

CPC ..... *E04F 15/185* (2013.01); *F24D 13/04* (2013.01); *E04F 15/02161* (2013.01); *E04F 2290/023* (2013.01); *F24D 3/142* (2013.01)

(58) Field of Classification Search

CPC ..... E04F 15/185; E04F 2290/023; E04F 15/02161; E04F 15/182; E04F 15/186; F24D 13/04; F24D 3/142

See application file for complete search history.

(56) References Cited

U.S. PATENT DOCUMENTS

| | | | | |
|---|---|---|---|---|
| 9,328,520 | B1 * | 5/2016 | Kriser | E04F 15/185 |
| 9,890,959 | B2 * | 2/2018 | Houle | E04B 5/48 |
| 10,215,423 | B2 * | 2/2019 | Bordin | F24D 13/02 |
| 10,975,582 | B2 * | 4/2021 | Kaiser | E04F 15/186 |
| 2009/0230113 | A1 * | 9/2009 | Batori | F24D 3/142 52/745.05 |
| 2016/0047131 | A1 * | 2/2016 | Larson | E04F 15/185 52/173.1 |

(Continued)

FOREIGN PATENT DOCUMENTS

| | | | | |
|---|---|---|---|---|
| CA | 3009164 | A1 * | 6/2017 | F24D 3/142 |
| GB | 2568614 | A * | 5/2019 | F24D 3/148 |

(Continued)

*Primary Examiner* — Phi D A

(74) *Attorney, Agent, or Firm* — Hemisphere Law, PLLC

(57) ABSTRACT

A decoupled floor underlayment with multiple-layer composite structures includes a wiring layer, and a adhesive layer. The wiring layer includes a body of the wiring layer, and a plurality of protrusion portions disposed on the body of the wiring layer. The protrusion portions include a first protrusion portion and a second protrusion portion with different types of structures. The first protrusion portion and the second protrusion portion are arranged in a staggered manner in an equidistant manner on the body of the wiring layer row by row, column by column. After mortars embedded in the cavity is solidified, blocks formed by the mortars solidification have different expansion coefficients when encountering with heat and cold, and can better cope with an unbalanced stress environment, and more effectively alleviate the damage to a tile floor caused by evacuations of the blocks.

18 Claims, 5 Drawing Sheets

(56) References Cited

U.S. PATENT DOCUMENTS

| | | | | |
|---|---|---|---|---|
| 2016/0377300 | A1* | 12/2016 | Larson | E04F 15/182 219/532 |
| 2017/0003035 | A1* | 1/2017 | Wischemann | F24D 3/142 |
| 2017/0175389 | A1* | 6/2017 | Liang | E04F 15/182 |
| 2018/0051893 | A1* | 2/2018 | Bordin | E04B 5/48 |
| 2019/0226686 | A1* | 7/2019 | White | F24D 3/122 |
| 2021/0029782 | A1* | 1/2021 | White | H05B 3/06 |
| 2022/0082269 | A1* | 3/2022 | White | F24D 3/122 |
| 2024/0351303 | A1* | 10/2024 | White | B32B 7/06 |
| 2025/0034885 | A1* | 1/2025 | Chen | E04F 15/185 |

FOREIGN PATENT DOCUMENTS

| | | | | | |
|---|---|---|---|---|---|
| GB | 2570639 | A | * | 8/2019 | F24D 3/122 |
| GB | 2585948 | A | * | 1/2021 | E04C 2/525 |
| JP | H11131770 | A | * | 5/1999 | |

* cited by examiner

DECOUPLED FLOOR UNDERLAYMENT

The disclosure relates to under-floor heating technologies, in particular to a decoupled floor underlayment.

BACKGROUND

Underfloor radiation heating was generally shortened to floor heating. In the floor heating, a floor acts as a radiator, the ground is uniformly heated by a heat medium of a radiation layer in a floor. The floor heating uses heat accumulation of the ground itself and a rule that heat is radiated upward to transfer heat from bottom to top, so as to achieve a heating purpose. According to differences of the thermal medium, the floor heating is classified into water heating floor and electric heating floor.

A Chinese utility model patent with publication number CN209703935U discloses a floor heating underlayment. The floor heating underlayment includes a base, a plurality of fixing columns, and positioning pieces. The fixing columns are arranged on the base. A channel adaptively accommodating a floor heating pipe is formed between two adjacent fixing columns, and a groove into which water cement is laid being formed in the middle of the fixing columns. Positioning pieces are adapted to secure fixing pillars at a joint of two adjacent underfloor heating underlayment.

In practical application, for floor heating in different regions, such as indoor and outdoor floors, there is a difference in wiring intervals of a water heating pipe or a heating pipe, and heating in the region will be different which causes a difference in shrinkage between a tile and a base layer, and also will cause an imbalance in stress, and damaging the tile. In addition, in different areas of the building, solar irradiation intensity on the ground of a building is different, and the stress after the ceramic tile and the mortar are heated and cooled is also different, so that the ceramic tile, the floor and the like are more prone to cracking and damage.

SUMMARY

A decoupled floor underlayment provided can achieve flexible wiring of a water heating pipe or a heating cable, thereby improving the thermal insulation effect, and at the same time, preventing ceramic tiles from cracking and being air-blown, thereby improving service life and safety performance of the ceramic tiles. The technical solution of the present invention is as follows.

The floor underlayment with multiple-layer composite structures includes a wiring layer, and a adhesive layer disposed on bottom of the wiring layer. The wiring layer includes a body of the wiring layer, and a plurality of protrusion portions disposed on the body of the wiring layer. The plurality of the protrusion portions are arranged in a rectangular array on the body of the wiring layer. A wiring groove for embedding pipes is provided by adjacent protrusion portions. A pipe fixing element disposed in the wiring groove is provided by at least a partial-convex outer wall of the plurality of the protrusion portions. An accommodation space for pipes is provided by the pipe fixing element between the adjacent protrusion portions and the body of the wiring layer. The pipes are fixed in the accommodation space for pipes. The protrusion portions includes a first protrusion portion and a second protrusion portion with different types of structures. The first protrusion portion and the second protrusion portion are arranged in a staggered manner in an equidistant manner on the body of the wiring layer row by row, column by column. A middle portion of the first protrusion portion is provided to a first concave structure with a small top portion and a large bottom portion. A second concave structure with a small top portion and a large bottom portion is provided between the adjacent protrusion portions defining. A middle portion of the second protrusion portion is provided to a third concave structure with a small top portion and a large bottom portion.

As a preferred embodiment, the first protrusion portion includes a first cylinder disposed on the body of the wiring layer, and first petal-shaped bosses symmetrically disposed on two sides of the first cylinder, a part of an outer wall of the first petal-shaped boss facing away from a side of the first cylinder is concave to form a first arc-shaped wall, a part of the outer wall of the first petal-shaped boss facing the side of the first cylinder is concave to form a second arc-shaped wall, a cavity of an elliptical cone ring with the small top portion and the large bottom portion is formed between first arc-shaped walls of two sets of first petal-shaped bosses, and a cavity of circular truncated cone with the small top portion and the large bottom portion is formed between second arc-shaped walls of the adjacent protrusion portions.

As a preferred embodiment, the second protrusion portion includes a second cylinder disposed on the body of the wiring layer, and second petal-shaped bosses symmetrically disposed on two sides of the second cylinder, a part of the outer wall of the second petal-shaped boss facing the side of the second cylinder is concave to form a third arc-shaped wall, and a cavity of an cone ring with the small top portion and the large bottom portion is formed between third arc-shaped walls of two sets of second petal-shaped bosses.

As a preferred embodiment, the protrusion portions and the wiring layer are integrally formed by injection molding, and material of the wiring layer is a high-molecular polymer.

As a preferred embodiment, the pipe fixing element is a column with a small cross-sectional top area and a large cross-sectional bottom area.

As a preferred embodiment, the pipe fixing element is a hemispherical convex point.

As a preferred embodiment, the adhesive layer and the wiring layer are bonded at a high temperature, and the adhesive layer is a fibrous fabric.

The present invention adopting above schemes has following beneficial effects.

1. The wiring groove for accommodating pipes is formed between the adjacent protrusion portions. Water heating pipes or heating cables can be directly wired and routed on the wiring layer, so that the operation is flexible and the construction is convenient.
2. Mortars can be fully filled in the cavity at the middle of the protrusion portion and be not prone to overflow during working on the building. The cavity of the protrusion portion is with a smaller top portion and the larger bottom portion, that areas contacting with the ceramic tiles are increased, so that the ceramic tiles are more stable.
3. Due to different structures of the protrusion portions of adjacent horizontal rows, after the mortars embedded in the cavity is solidified mortars, blocks formed by the mortars have different expansion coefficients when encountering with heat and cold, and can better meet with an unbalanced stress environment, and more effectively alleviate the damage of the ceramic tiles floor.

BRIEF DESCRIPTION OF THE DRAWINGS

In order to illustrate the technical solution in the embodiments of the disclosure or the prior art more clearly, a brief description of drawings required in the embodiments or the prior art is given below. Obviously, the drawings described below are only some of the embodiments of the disclosure. For ordinary technicians in this field, other drawings can be obtained according to the structures shown in these drawings without any creative effort.

In figures: 1. adhesive layer; 2. wiring layer; 21. first protrusion portion; 211. first cylinder; 212. first petal-shaped boss; 2121. first arc-shaped wall; 2122. second arc-shaped wall; 22. second protrusion portion; 221. second cylinder; 222. second petal-shaped boss; 2221. third arc-shaped wall; 23. pipe fixing element; 3. wiring groove; 4. pipe.

DETAILED DESCRIPTION OF THE EMBODIMENTS

In order to make the purpose, technical solution and advantages of the disclosure more clearly, the disclosure is further described in detail in combination with the drawings and embodiments. It is understood that the specific embodiments described herein are used only to explain the disclosure and are not configured to define it. On the basis of the embodiments in the disclosure, all other embodiments obtained by ordinary technicians in this field without any creative effort are covered by the protection of the disclosure.

The terms "first", "second", "third", "fourth", if any, in the specification, claims and drawings of this application are configured to distinguish similar objects but need not be configured to describe any particular order or sequence of priorities. It should be understood that the data used here are interchangeable where appropriate, in other words, the embodiments described can be implemented in order other than what is illustrated or described here. In addition, the terms "include" and "have" and any variation of them, can encompass other things. For example, processes, methods, systems, products, or equipment that comprise a series of steps or units need not be limited to those clearly listed, but may include other steps or units that are not clearly listed or are inherent to these processes, methods, systems, products, or equipment.

Figure 1:
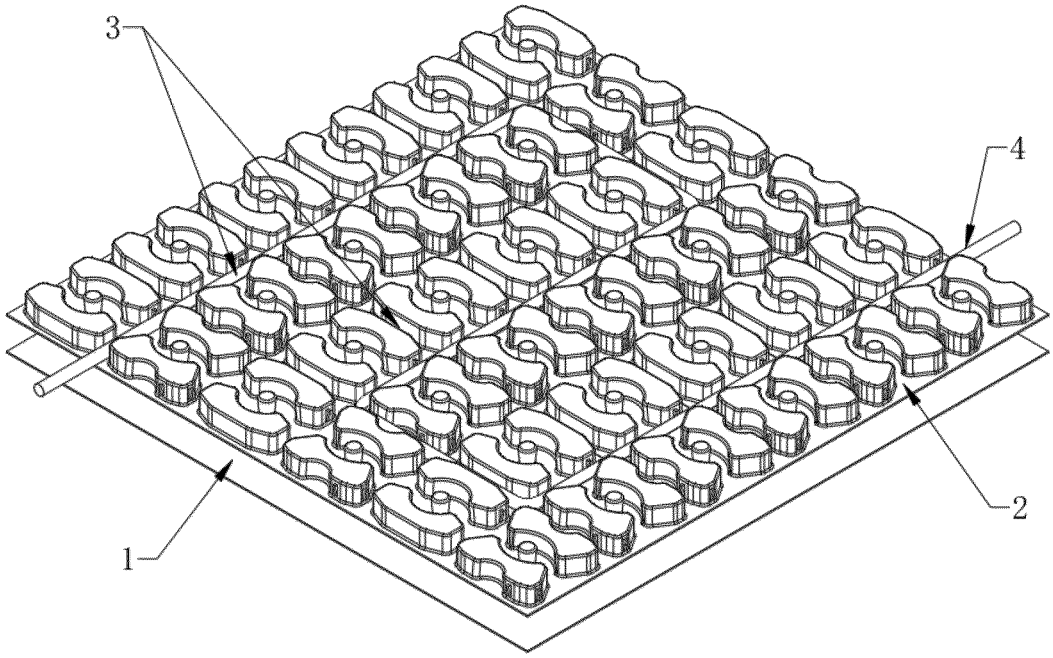
FIG. 1 illustrates a perspective view of a decoupled floor underlayment.
Figure 2:
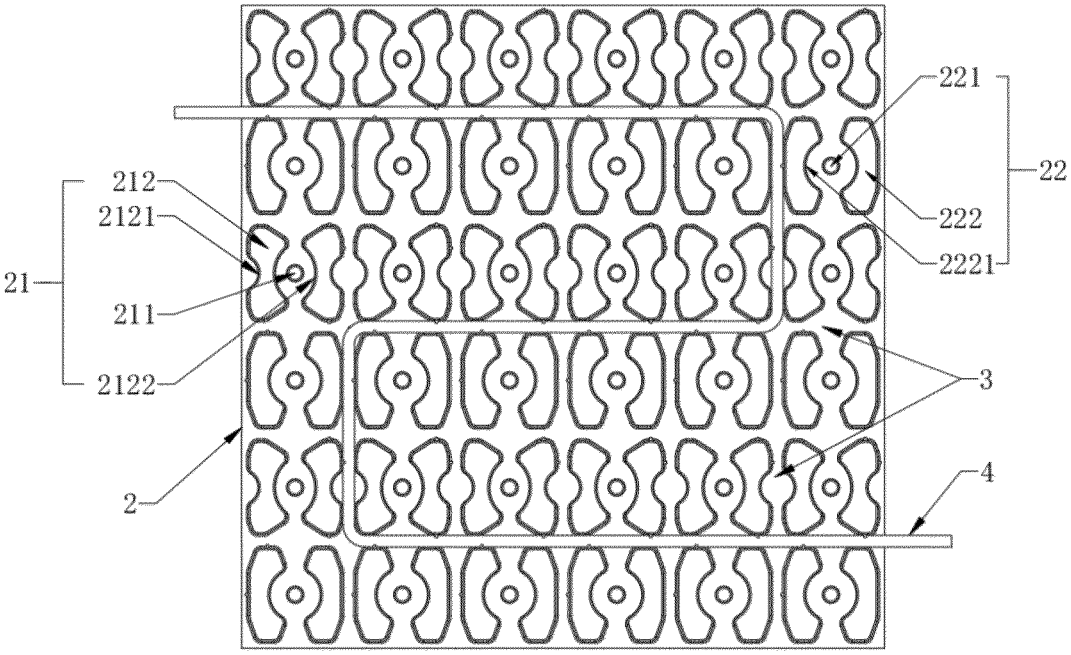
FIG. 2 illustrates a top plan view of a decoupled floor underlayment.
Figure 3:
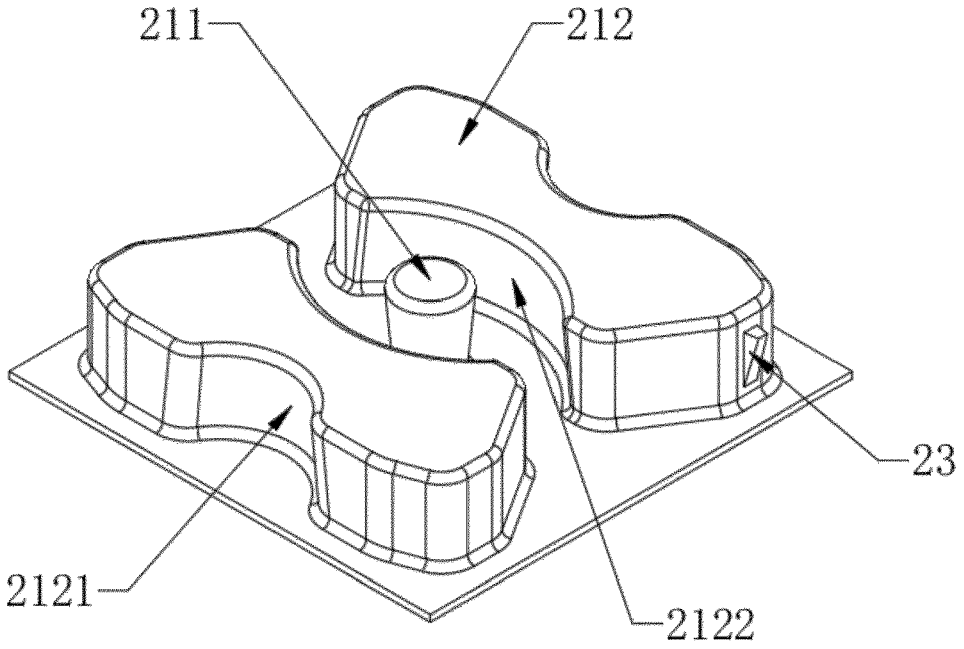
FIG. 3 illustrates a structure diagram of a first protrusion portion.
Figure 4:
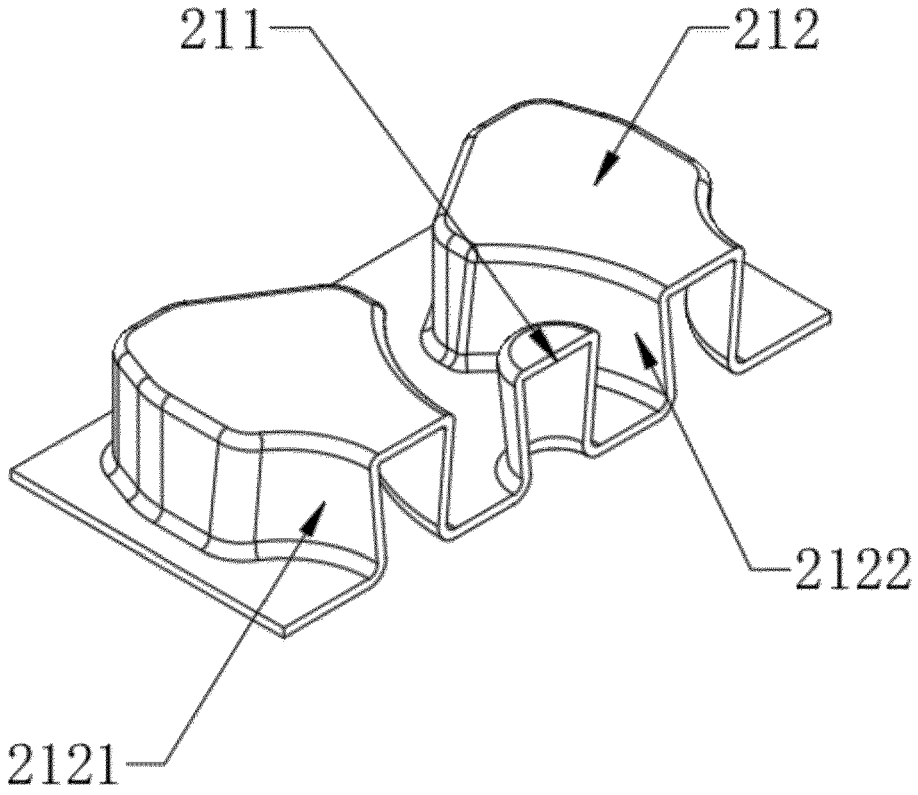
FIG. 4 illustrates a section view of a first protrusion portion.
Figure 5:
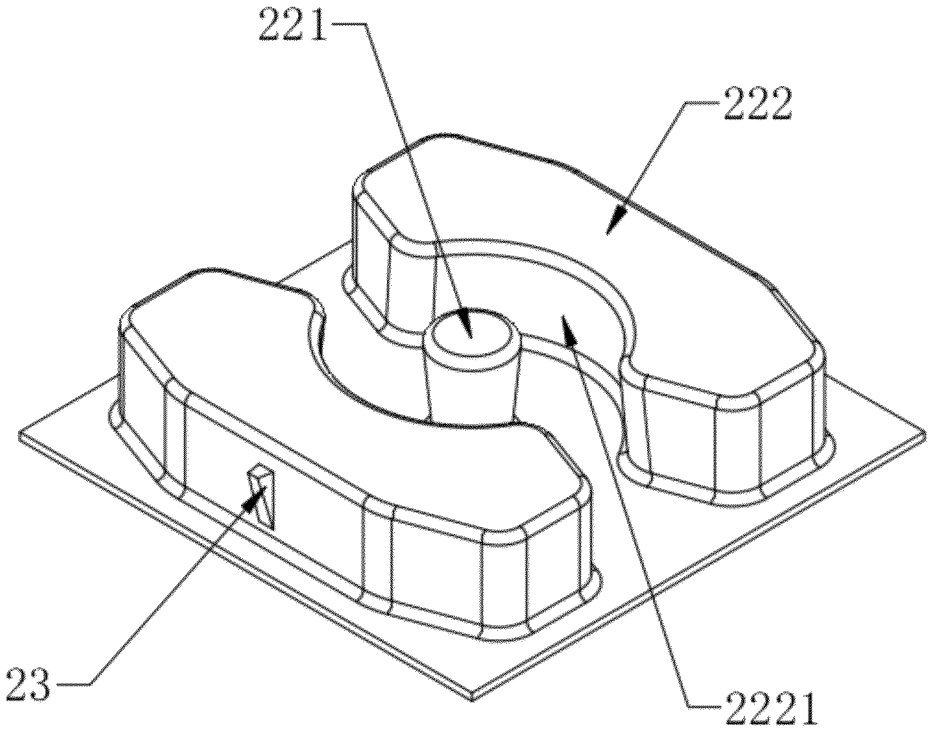
FIG. 5 illustrates a structure diagram of a second protrusion portion.
Figure 6:
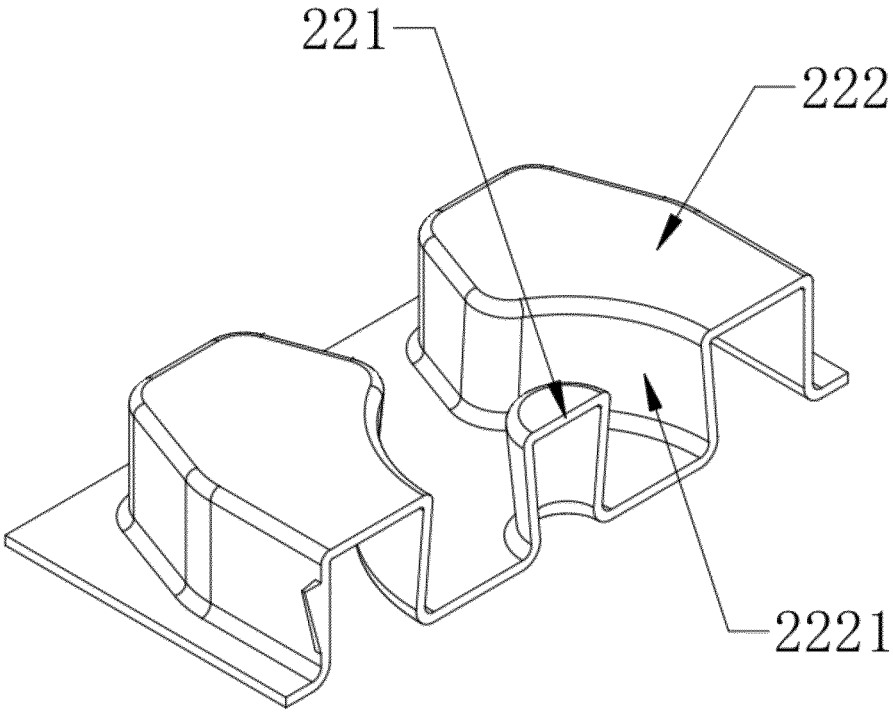
FIG. 6 illustrates a section view of a second protrusion portion.
Figure 7:
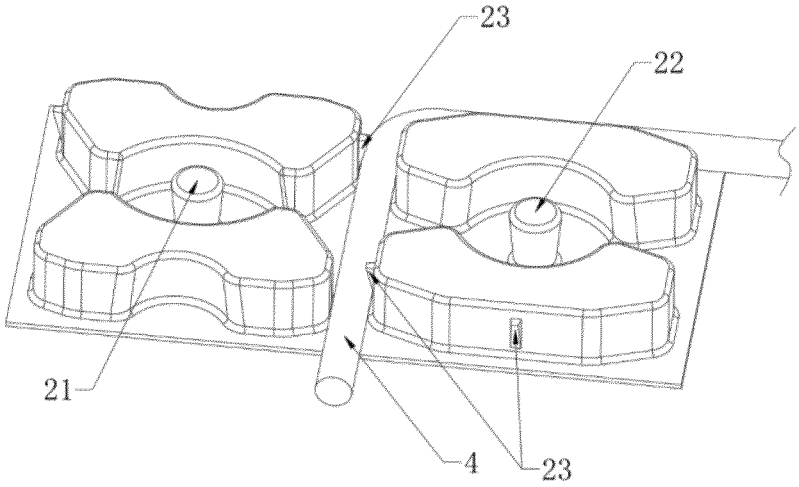
FIG. 7 illustrates a structure diagram of a first embodiment of a pipe fixing element.
Figure 8:
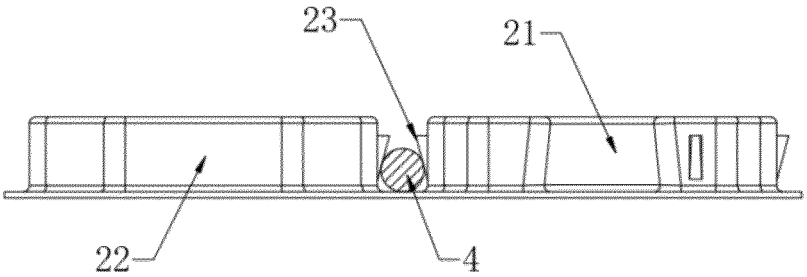
FIG. 8 illustrates a section view of a first embodiment of a pipe fixing element.
Figure 9:
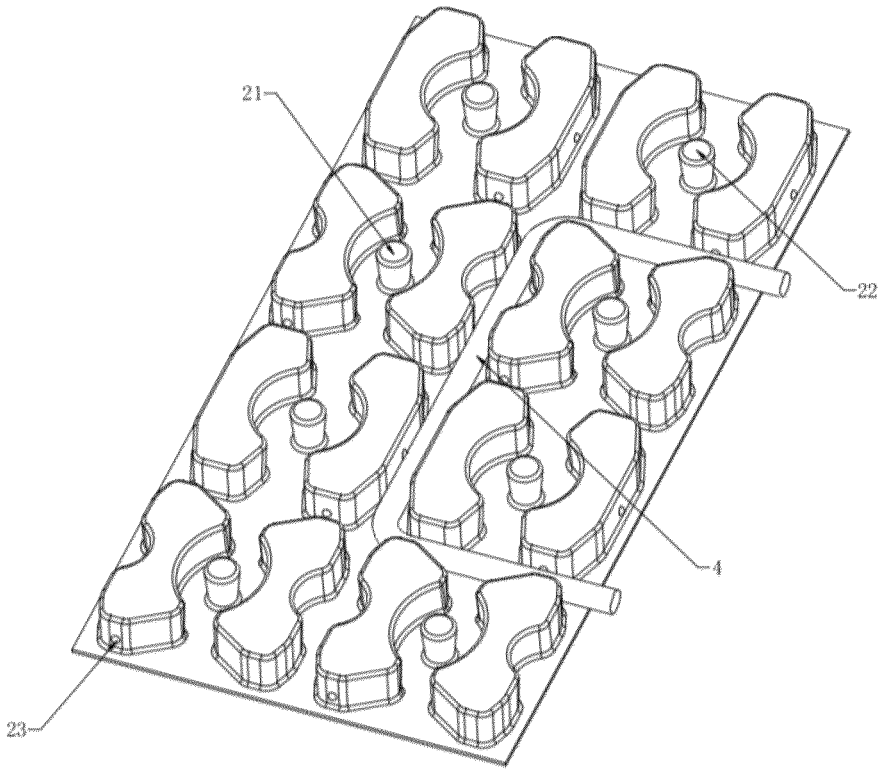
FIG. 9 illustrates a structure diagram of a second embodiment of a pipe fixing element.
Figure 10:
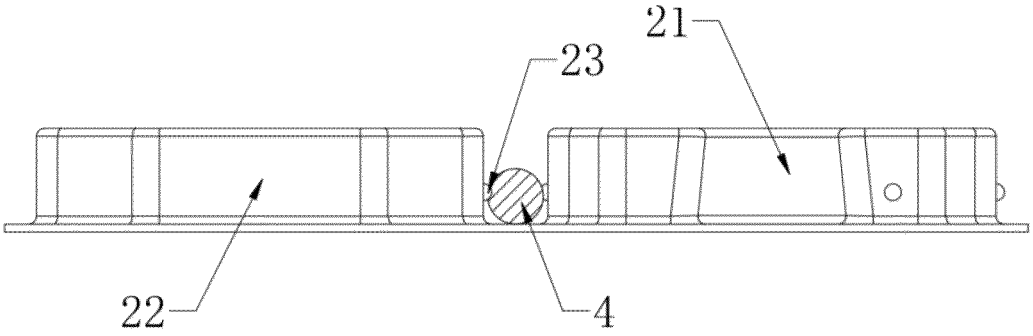
FIG. 10 illustrates a section view of a second embodiment of a pipe fixing element.

Referring to FIGS. 1-10, a perspective view of a decoupled floor underlayment is illustrated in FIG. 1, a top plan view of a decoupled floor underlayment is illustrated in FIG. 2, a structure diagram of a first protrusion portion is illustrated in FIG. 3, a section view of a first protrusion portion is illustrated in FIG. 4, a structure diagram of a second protrusion portion is illustrated in FIG. 5, a section view of a second protrusion portion is illustrated in FIG. 6, a structure diagram of a first embodiment of a pipe fixing element is illustrated in FIG. 7, a section view of a first embodiment of a pipe fixing element is illustrated in FIG. 8, a structure diagram of a second embodiment of a pipe fixing element is illustrated in FIG. 9, and a section view of a second embodiment of a pipe fixing element is illustrated in FIG. 10.

A floor underlayment with multiple-layer composite structures includes a wiring layer 2, and a adhesive layer 1 disposed on bottom of the wiring layer 2. The adhesive layer 1 and the wiring layer 2 are bonded at a high temperature, and the adhesive layer 1 is a fibrous fabric. The fibrous fabric may not only enhance tensile strength and fracture resistance of the wiring layer 2, but also enhance adhesion to a base of ground. In detail, by adding an antibacterial component into the fiber fabric, the decoupling heating pad has an anti-mildew and antibacterial effect, thereby preventing mildew from being generated in the gap of ceramic tiles.

In this embodiment, material of the wiring layer 2 is a high-molecular polymer. The wiring layer 2 includes a body of the wiring layer 2, and a plurality of protrusion portions disposed on the body of the wiring layer 2. The plurality of the protrusion portions and the wiring layer 2 are integrally formed by injection molding. The wire layer of the high-molecular polymer can prevent water and steam from permeating into the base, thereby reducing the occurrence of mildew. The plurality of the protrusion portions are arranged in a rectangular array on the body of the wiring layer 2. When there are heavy objects on the ceramic tiles, the rectangular array of protrusion portions can reduce ground load, thereby reducing the pressure on the ceramic tiles, and playing the roles of dispersing the load and protecting the ceramic tiles. A wiring groove 3 for embedding pipes 4 is formed between the adjacent protrusion portions. Water heating pipes or heating cables can be directly wired and routed on the wiring layer 2, so that the operation is flexible and the construction is convenient.

In this embodiment, the protrusion portions includes a first protrusion portion 21 and a second protrusion portion 22 with different types of structures. The first protrusion portion 21 and the second protrusion portion 22 are arranged in a staggered manner in an equidistant manner on the body of the wiring layer 2 row by row, column by column. A middle portion of the first protrusion portion 21 is provided to a first concave structure with a small top portion and a large bottom portion. A second concave structure with a small top portion and a large bottom portion is provided between the adjacent protrusion portions defining. A middle portion of the second protrusion portion 22 is provided to a third concave structure with a small top portion and a large bottom portion. Understandably, structures of the protrusion portions of adjacent horizontal rows are different. After mortars embedded in the cavity is solidified, blocks formed by the mortars solidification have different expansion coefficients when encountering with heat and cold, and can better cope with an unbalanced stress environment, and more effectively alleviate the damage to floor of the ceramic tiles caused by evacuations of the blocks.

In this embodiment, the first protrusion portion 21 includes a first cylinder 211 disposed on the body of the wiring layer 2, and first petal-shaped bosses 212 symmetrically disposed on two sides of the first cylinder 211, a part of an outer wall of the first petal-shaped boss 212 facing away from a side of the first cylinder 211 is concave to form a first arc-shaped wall 2121, a part of the outer wall of the first petal-shaped boss 212 facing the side of the first cylinder 211 is concave to form a second arc-shaped wall 2122, a cavity of an elliptical cone ring with the small top portion and the large bottom portion is formed between first arc-shaped walls 2121 of two sets of first petal-shaped bosses 212, and a cavity of circular truncated cone with the small top portion and the large bottom portion is formed between second arc-shaped walls 2122 of the adjacent protrusion portions. The second protrusion portion 22 includes a second cylinder 221 disposed on the body of the wiring layer 2, and second petal-shaped bosses 222 symmetrically disposed on two sides of the second cylinder 221, a part of the outer wall of the second petal-shaped boss 222 facing the side of the second cylinder 221 is concave to form a third arc-shaped wall 2221, and a cavity of an cone ring with the small top portion and the large bottom portion is formed between third arc-shaped walls 2221 of two sets of second petal-shaped bosses 222. Understandably, no matter the cavity of an elliptical cone ring, the cavity of circular truncated cone, or the cavity of an cone ring, the cross section of the cavity is a dovetail structure with the large top portion and the small bottom portion, which increases contact areas with the ceramic tiles and makes the ceramic tiles more stable.

In this embodiment, the wiring groove 3 for embedding pipes 4 is provided by adjacent protrusion portions. A pipe fixing element 23 disposed in the wiring groove 3 is provided by at least a partial-convex outer wall of the plurality of the first petal-shaped bosses 212 or the second petal-shaped bosses 222. An accommodation space for pipes 4 is provided by the pipe fixing element 23 between the adjacent protrusion portions of the first petal-shaped bosses 212 or the second petal-shaped bosses 222, and the body of the wiring layer 2. The pipes 4 are fixed in the accommodation space for pipes 4.

As shown in FIG. 7, the pipe fixing element 23 is a column with a small cross-sectional top area and a large cross-sectional bottom area. As shown in FIG. 8, pipes 4 are pressed into the wiring groove 3 through elastic deformation of the protrusion portion. Columns at two sides of the wiring groove 3 form a wedge structure with the large top portion and a small bottom portion, so as to apply a downward pressure to pipes 4 and prevent pipes 4 in the wiring groove 3 from moving upwards, so that pipes 4 are firmly constrained in the wiring groove 3.

As shown in FIG. 9, the pipe fixing element 23 is a hemispherical convex point. Multiple hemispherical convex points can be arranged on the same side wall in a staggered manner. As shown in FIG. 10, pipes 4 are pressed into the wiring groove 3 through elastic deformation of the protrusion portion. The hemispherical convex points at the two sides of the wiring groove 3 apply a pressing force pointing to the centre of the wiring groove 3 to pipes 4. By means of the friction and the pressing force, pipes 4 are firmly constrained in the wiring groove 3.

It is to be noted that the references to "first", "second", etc. in the disclosure are for descriptive purpose only and neither be construed or implied the relative importance nor indicated as implying the number of technical features. Thus, feature defined as "first" or "second" can explicitly or implicitly include one or more such features. In addition, technical solutions between embodiments may be integrated, but only on the basis that they can be implemented by ordinary technicians in this field. When the combination of technical solutions is contradictory or impossible to be realized, such combination of technical solutions shall be deemed to be non-existent and not within the scope of protection required by the disclosure.

It should be noted that the embodiments number of this disclosure above is for description only and do not represent the advantages or disadvantages of embodiments. And in this disclosure, the term "including", "include" or any other variants is intended to cover a non-exclusive contain. So that the process, the devices, the items, or the methods includes a series of elements not only include those elements, but also include other elements not clearly listed, or also include the inherent elements of this process, devices, items, or methods. In the absence of further limitations, the elements limited by the sentence "including a . . . " do not preclude the existence of other similar elements in the process, devices, items, or methods that include the elements.

The above disclosed preferred embodiments of the invention are intended only to assist in the elaboration of the invention. The preferred embodiment does not elaborate on all the details and does not limit the invention to a specific embodiment. Obviously, according to the contents of this instruction manual, a lot of amendments and changes can be made. These embodiments are selected and described in detail in this specification for the purpose of better explaining the principle and practical application of the invention, so that the technical personnel in the technical field can better understand and utilize the invention. The invention is limited only by the claims and their full scope and equivalents.

The above are only the preferred embodiments of this disclosure and do not therefore limit the patent scope of this disclosure. And equivalent structure or equivalent process transformation made by the specification and the drawings of this disclosure, either directly or indirectly applied in other related technical fields, shall be similarly included in the patent protection scope of this disclosure.

The invention claimed is:

1. A decoupled floor underlayment, the floor underlayment with multiple-layer composite structures comprising a wiring layer, and an adhesive layer disposed on a bottom of the wiring layer, the wiring layer comprising a body of the wiring layer, and a plurality of protrusion portions disposed on the body of the wiring layer, the plurality of the protrusion portions being arranged in a rectangular array on the body of the wiring layer, a wiring groove for embedding pipes being defined by adjacent protrusion portions; a pipe-fixing element disposed in the wiring groove being defined by at least a partial-convex outer wall of the plurality of the protrusion portions, an accommodation space for pipes being defined by the pipe-fixing element between the adjacent protrusion portions and the body of the wiring layer, the pipes fixed in the accommodation space for pipes; the protrusion portions comprising a first protrusion portion and a second protrusion portion with different structures, the first protrusion portion and the second protrusion portion arranged in a staggered manner in an equidistant manner on the body of the wiring layer row by row, column by column, a middle portion of the first protrusion portion defining a first concave structure with a smaller top portion and a larger bottom portion, a second concave structure with a smaller top portion and a larger bottom portion defined between the adjacent protrusion portions, and a middle portion of the second protrusion portion defining a third concave structure with a smaller top portion and a larger bottom portion.

2. The floor underlayment according to claim 1, wherein the first protrusion portion comprises a first cylinder disposed on the body of the wiring layer, and first petal-shaped bosses symmetrically disposed on two sides of the first cylinder, a part of an outer wall of the first petal-shaped boss facing away from a side of the first cylinder is concave to form a first arc-shaped wall, a part of the outer wall of the first petal-shaped boss facing the side of the first cylinder is concave to form a second arc-shaped wall, a cavity of an elliptical cone ring with the smaller top portion and the larger bottom portion is formed between first arc-shaped walls of two sets of first petal-shaped bosses, and a cavity of circular truncated cone with the smaller top portion and the larger bottom portion is formed between second arc-shaped walls of the adjacent protrusion portions.

3. The floor underlayment according to claim 2, wherein the second protrusion portion comprises a second cylinder disposed on the body of the wiring layer, and second petal-shaped bosses symmetrically disposed on two sides of the second cylinder, a part of the outer wall of the second petal-shaped boss facing the side of the second cylinder is concave to form a third arc-shaped wall, and a cavity of an cone ring with the smaller top portion and the larger bottom portion is formed between third arc-shaped walls of two sets of second petal-shaped bosses.

4. The floor underlayment according to claims 3, wherein the protrusion portions and the wiring layer are integrally formed by injection molding, and material of the wiring layer is a high-molecular polymer.

5. The floor underlayment according to claim 1, wherein the pipe-fixing element is a column with a small cross-sectional top area and a large cross-sectional bottom area.

6. The floor underlayment according to claim 1, wherein the pipe-fixing element is a hemispherical convex point.

7. The floor underlayment according to claim 1, wherein the adhesive layer and the wiring layer are bonded at a high temperature, and the adhesive layer is a fibrous fabric.

8. A decoupled floor underlayment, the floor underlayment with multiple-layer composite structures comprising a wiring layer, and an adhesive layer disposed on a bottom of the wiring layer, the wiring layer comprising a body of the wiring layer, and a plurality of protrusion portions disposed on the body of the wiring layer, the protrusion portions comprising first protrusion portions, and second protrusion portions with different structures from the first protrusion portions, wherein the first protrusion portions and the second protrusion portions are arranged in an array, the first protrusion portions arranged into a plurality of parallel rows; the second protrusion portions arranged into a plurality of parallel rows; the rows of the first protrusion portions and the rows of the second protrusion portions are alternately arranged; and in each column, the first protrusion portions and the second protrusion portions are alternately arranged;

wherein the first protrusion portion comprises a first boss disposed on the body of the wiring layer, and two C-shaped structures symmetrically disposed on two sides of the first boss, each C-shaped structure of the first protrusion portion includes an inner arcuate surface facing toward the first boss; and an outer arcuate surfaces facing outwardly, and the outer arcuate surface forming an arcuate recess in a middle position; and wherein the second protrusion portion comprises a second boss disposed on the body of the wiring layer, and two C-shaped structures symmetrically disposed on two sides of the second boss, each C-shaped structure of the second protrusion portion includes an inner arcuate surface facing toward the second boss; and an outer arcuate surfaces facing outwardly.

9. The floor underlayment according to claim 8, wherein each of the first protrusion portions forms a first ring-shaped concave with a smaller top and a lager bottom, the first ring-shaped concave is bounded by first boss and the two C-shaped structures; and each of the second protrusion portions forms a second ring-shaped concave with a smaller top and a larger bottom, the second ring-shaped concave is bounded by the second boss and the two C-shaped structures.

10. The floor underlayment according to claim 9, wherein each C-shaped structure forms a first inner hollow with a larger top and a smaller bottom.

11. The floor underlayment according to claim 9, wherein each of the first boss forms a first inner hollow cavity with a larger top and a smaller bottom; each of the second boss forms a second inner hollow cavity with a smaller top and a larger bottom.

12. The floor underlayment according to claim 9, wherein each of the first boss forms a first inner hollow cavity with a larger top and a smaller bottom; each of the second boss forms a second inner hollow cavity with a smaller top and a larger bottom.

13. The floor underlayment according to claims 8, wherein the first and second protrusion portions and the wiring layer are integrally formed by injection molding, and material of the wiring layer is a high-molecular polymer.

14. The floor underlayment according to claim 8, wherein the pipe-fixing element has a larger top and a smaller bottom.

15. The floor underlayment according to claim 8, wherein the pipe-fixing element is a hemispherical convex point.

16. The floor underlayment according to claim 8, wherein the adhesive layer and the wiring layer are bonded at a high temperature, and the adhesive layer is a fibrous fabric.

17. A decoupled floor underlayment, comprising a wiring layer, and an adhesive layer disposed on a bottom of the wiring layer, the wiring layer comprising a body of the wiring layer, and a plurality of protrusion portions disposed on the body of the wiring layer, the protrusion portions comprising first protrusion portions and a second protrusion portions, wherein the first protrusion portions and the second protrusion portions are arranged in an array, each of the first protrusion portions forms a first ring-shaped concave with a smaller top and a larger bottom; and each of the second protrusion portions forms a second ring-shaped concave with a smaller top and a larger bottom;

wherein the first protrusion portion comprises a first boss disposed on the body of the wiring layer, and two C-shaped structures symmetrically disposed on two sides of the first boss, each C-shaped structure of the first protrusion portion includes an inner arcuate surface facing toward the first boss; and an outer arcuate surfaces facing outwardly, and the outer arcuate surface forming an arcuate recess in a middle position; and wherein the second protrusion portion comprises a second boss disposed on the body of the wiring layer, and two C-shaped structures symmetrically disposed on two sides of the second boss, each C-shaped structure of the second protrusion portion includes an inner arcuate surface facing toward the second boss; and an outer arcuate surfaces facing outwardly, the first ring-shaped concave is bounded by the first boss and the two C-shaped structures symmetrically disposed on two sides of the first boss; the second ring-shaped concave is bounded by the second boss and the two C-shaped structures symmetrically disposed on two sides of the second boss.

18. The floor underlayment according to claim 17, further comprising pipe-fixing elements, the pipe-fixing elements are respectively disposed on different outer sides of one C-shaped structure of the first protrusion portion, and of the second protrusion portion.

* * * * *